US005885018A

United States Patent [19]

Sato

[11] Patent Number: 5,885,018

[45] Date of Patent: Mar. 23, 1999

[54] WRITING TOOL WITH A RING FOR MOUNTING ON A FINGER

[76] Inventor: Yoshihiro Sato, 515 Shirakuwa, Urawa-shi, Saitama-ken, Japan

[21] Appl. No.: 906,412

[22] Filed: Aug. 5, 1997

[51] Int. Cl.[6] ..... B43K 25/00; B43K 7/00

[52] U.S. Cl. ..... 401/8; 401/7

[58] Field of Search ..... 401/7, 8; D19/41

[56] References Cited

U.S. PATENT DOCUMENTS

| | | | |
|---|---|---|---|
| D. 212,981 | 12/1968 | Laybourne | 401/8 X |
| 2,177,205 | 10/1939 | Dalmas | 401/7 X |
| 2,709,419 | 5/1955 | Appel | 401/8 |
| 3,887,286 | 6/1975 | Bucey | 401/7 |
| 4,127,338 | 11/1978 | Laybourne | 401/8 |

FOREIGN PATENT DOCUMENTS

| | | | |
|---|---|---|---|
| 1264621 | 5/1961 | France | 401/7 |
| 327664 | 4/1930 | United Kingdom | 401/8 |
| 1253519 | 11/1971 | United Kingdom | 401/7 |

*Primary Examiner*—Steven A. Bratlie
*Attorney, Agent, or Firm*—David O'Reilly

[57] ABSTRACT

A writing tool having a ring (1) allowing the tool to be worn on a finger (2) immediately ready for writing. The writing tool has a ring-shaped portion (1) for receiving an index finger (2), a guide portion (3) for guiding the tool during writing extending from the ring-shaped portion (1) and a support for a writing instrument (4) such as a pen or pencil extending outward from the end of the guide portion (3). A unique characteristic is the formation of the finger mounting ring (1) at an oblique angle to guide portion (3) to allow comfortable, proper positioning on the finger (2) when writing.

6 Claims, 2 Drawing Sheets

WRITING TOOL WITH A RING FOR MOUNTING ON A FINGER

BACKGROUND OF THE INVENTION

1. Field of the Invention

This invention relates to a writing tool having a ring for inserting it on a finger to easily write while continuing some other action such as playing golf, touching the keys of a computer, turning over a chit, a slip, etc.

2. Background Information

Heretofore, this inventor invented a writing tool as shown in FIG. 6 of Patent Laid Open No. 7-214981 having ring part 1 for inserting on a finger 2, guide part 3 extending from ring part 1, and writing part 4 extending out of the end of guide part 3. Ring part 1 extends at right angles to guide part 3. However, ring part 1 does not adapt well to a finger, especially when an articulating finger is bent, ring part 1 presses against finger 2, causing difficulty in writing.

BRIEF DESCRIPTION OF THE INVENTION

This invention intends to eliminate such drawbacks. An object of this invention is to provide an improved writing tool having a ring comprising ring part 1 for insertion on finger 2, guide part 3 extending from ring part 1, and writing part 4 extending out of end of guide part 3, characterized by ring part 1 extending in an oblique rear upper direction. In use, finger 2 is inserted into ring part 1. Ring part 1 is adapted to finger 2 because ring part 1 extends in oblique rear upper direction, especially when an articulating finger is bent when writing. Ring part 1 does not press against finger 2 because expanded muscles deflect out of ring part 1.

The above and other novel features of the invention will be more fully understood from the following detailed description and the accompanying drawings, in which:

DETAILED DESCRIPTION OF THE INVENTION

Figure 1:
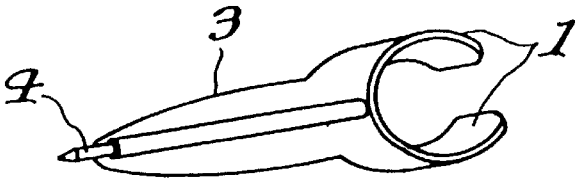
FIG. 1 is shows a bottom view of an embodiment of this invention.
Figure 2:
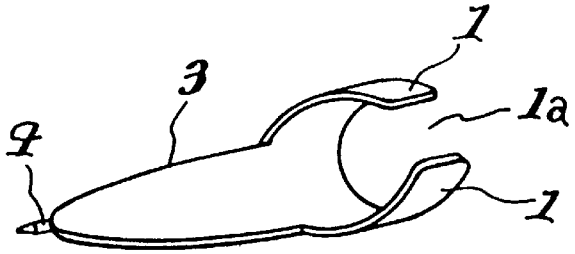
FIG. 2 is a perspective view from an upper portion of the embodiment of FIG. 1.
Figure 3:
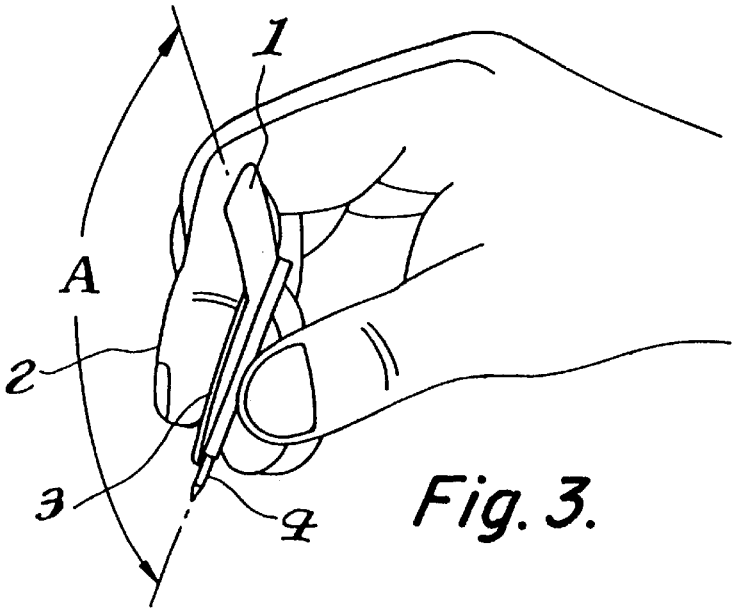
FIG. 3 is a perspective view showing the embodiment of FIG. 1 in use.

As shown in FIGS. 1 and 2, one embodiment of this invention is comprised of ring part 1 for inserting on finger 2, of plastic or metal. Guide part 3, in a trough shape corresponding to the shape of finger 2 extends from ring part 1 and writing part 4 extends out of guide part 3. Ring part 1 has a recess 1*a* and ring part 1 extends in an oblique rear upward direction. The angle A of oblique rear upper direction is approximately 135°, but may be in the range of 110° to 160°. Writing part 4 may be a ball point refill or a pencil, but it may also be an extendible lead. FIG. 3 shows this embodiment in use.

Figure 4:
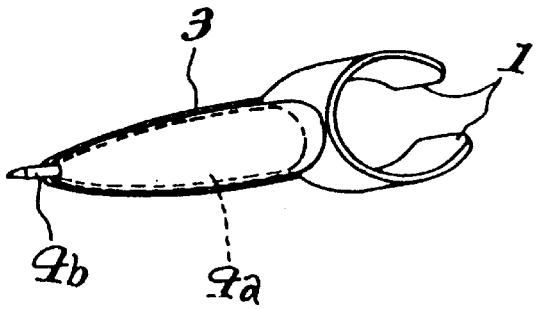
FIG. 4 shows a bottom view of another embodiment of the invention.

FIG. 4 is a bottom view of a second embodiment of the invention in which ring part 1 and guide part 3 are integrally formed of plastic or die cast metal, and guide part 3 is a thick hollow member with hollow part being ink tank 4*a* and ball pen writing part 46 inserted in the outlet end.

Figure 5:
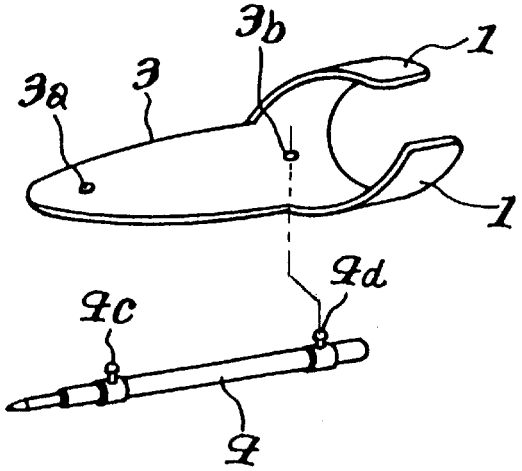
FIG. 5 shows a bottom view of still another embodiment of the invention.
Figure 6:
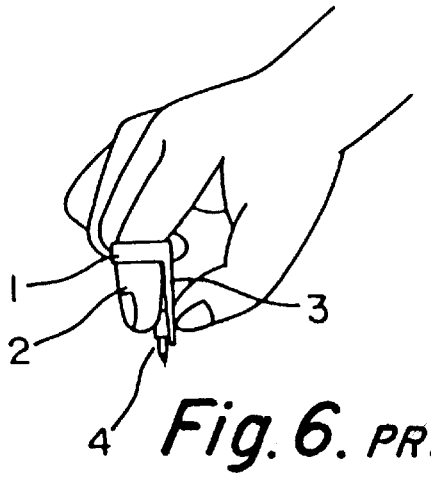
Fig. 6. PRIOR ART
FIG. 6 is a perspective view illustrating use of a prior device.

FIG. 5 is a bottom view of still another embodiment of the invention in which through holes 3*a*, 3*b* are provided at the front and rear of guide part 3. Projections 4*c*, 4*d* at the front and rear of writing part 4 snap into through holes 3*a*, 3*b*. This makes it possible to replace writing part 4.

The method of use is now explained. When not in use, ring part 1 is inserted on finger 2 directing writing part 4 upwards. In use, ring part 1 is inserted on finger 2 directing writing part 4 downward with nip of writing part 4 between the forefinger and the thumb. Writing part 4 is firmly held in place by the end of guide part 3 and ring part 1 without deflecting from its direction, making it possible to accurately and comfortably write characters, figures, etc. Ring part 1 is adapted to finger 2 because ring part 1 extends in an oblique rear upwards direction, especially when an articulating finger is bent to write, ring part 1 does not press against finger 2 because expanded muscles deflect out of ring 1 for easy writing.

As explained above, according to the invention, writing part 4 is firmly held by the end of guide part 3 and ring part 1 without deflecting from its direction, making it possible to accurately and comfortably write characters, figures, etc. Ring part 1 is adapted to finger 2 because ring part 1 extends in an oblique rear upward direction, especially when an articulating finger is bent in writing. Ring part 1 does not press finger 2 because expanded muscles deflect out of the ring 1 for easy writing.

This invention is not to be limited by the embodiment shown in the drawings and described in the description which is given by way of example and not of limitation, but only in accordance with the scope of the appended claims.

What is claimed is:

1. A writing tool comprising; a ring-shaped portion (1) constructed and arranged to comfortably fit around a finger (2); a guide portion (3) extending downward and away from said ring-shaped portion (1); said guide portion (3) constructed to fit the contour of a finger (2); said guide portion including writing means (4) to be guided by the finger (2); said ring-shaped portion (1) extending obliquely upward and away from said guide portion (3); whereby said writing means may be easily manipulated when the finger (2) is being articulated from straight to bent position and vice versa.

2. A writing tool according to claim 1 in which said oblique upward extending ring is integrally formed on said guide portion.

3. A writing tool according to claim 2 in which said writing means comprises an ink storage tank formed in said guide portion and a ball pen tip on the end of said guide portion.

4. A writing tool according to claim 2 in which said writing means comprises, a writing instrument; a pair of projections formed on said writing instrument; and a pair of holes in said guide portion for receiving said pair of projections whereby said writing instrument may be easily attached or detached from said writing tool.

5. The writing tool according to claim 1 in which said oblique angle is in the range of 100° to 160°.

6. The writing tool according to claim 5 in which said oblique angle is 135°.

* * * * *